United States Patent [19]

Nakajima et al.

[11] Patent Number: 4,506,007

[45] Date of Patent: Mar. 19, 1985

[54] METHOD FOR PROCESSING COLOR PHOTOGRAPHIC MATERIALS

[75] Inventors: Junya Nakajima; Isamu Itoh; Kiyohiko Yamamuro; Eiiti Ogawa, all of Kanagawa, Japan

[73] Assignee: Fuji Photo Film Co., Ltd., Kanagawa, Japan

[21] Appl. No.: 598,104

[22] Filed: Apr. 9, 1984

[30] Foreign Application Priority Data

Apr. 8, 1983 [JP] Japan ..... 58-61708

[51] Int. Cl.[3] ..... G03C 7/00

[52] U.S. Cl. ..... 430/393; 430/430

[58] Field of Search ..... 430/393, 430

[56] References Cited

U.S. PATENT DOCUMENTS

| | | | |
|---|---|---|---|
| 3,772,020 | 11/1973 | Smith | 430/393 |
| 3,893,858 | 7/1975 | Wabnitz | 430/393 |
| 4,144,068 | 3/1979 | Ishibashi et al. | 430/393 |
| 4,242,442 | 12/1980 | Idota et al. | 430/393 |
| 4,328,306 | 5/1982 | Idota et al. | 430/430 |
| 4,446,225 | 5/1984 | Kishimoto et al. | 430/430 |
| 4,458,010 | 7/1984 | Yamamuro et al. | 430/430 |

*Primary Examiner*—J. Travis Brown

*Attorney, Agent, or Firm*—Sughrue, Mion, Zinn, Macpeak and Seas

[57] ABSTRACT

A method for processing an exposed silver halide color photographic material by development and desilvering is described, which comprises the steps of (1) treating said material in a color developing bath, (2) treating the developed material in a bath having incorporated therein at least one compound of formula (I) or a salt thereof:

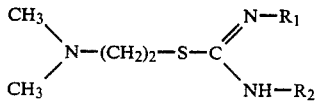

(I)

and (3) treating said material in a bath having bleaching or bleach-fixing ability.

9 Claims, No Drawings

METHOD FOR PROCESSING COLOR PHOTOGRAPHIC MATERIALS

BACKGROUND OF THE INVENTION

The present invention relates to a method for processing an exposed silver halide color photographic material by a sequence of development, bleaching and fixing (such a process is hereunder also referred to as color photographic processing). More particularly, the invention relates to a color photographic processing method that can be completed in a shortened period of time by accelerated bleaching action. Specifically, the invention relates to a bleaching process capable of providing a color photographic image of good quality by performing consistent and adequate bleaching over an extended period of time with minimum deterioration with the elapse of time in performance.

The two basic steps of the processing of silver halide color photographic materials are color development and desilvering. In the color development step, the silver halide in the exposed silver halide photographic material is reduced by a color developing agent to form silver and the oxidized color developing agent reacts with a coupler to provide a dye image. Thereafter, the color photographic material enters the desilvering step wherein by the action of certain types oxidizing agent (conventionally referred to as a bleaching agent), the silver formed in the development step is oxidized and eliminated from the photographic material by being dissolved with a silver ion complexing agent conventionally referred to as a fixing agent. As a result, the final image formed in the photographic material is a dye image. The actual photographic process involves, in addition to the two basic steps of color development and desilvering, auxiliary steps performed either for the purpose of maintaining the desired photographic and physical properties of the image or for the purpose of improving the archival quality of the image. Among the solutions used in auxiliary steps are a hardening bath used to prevent excessive softening of the light-sensitive layer during processing, a stopping bath that effectively stops the development reaction, an image stabilizing bath that stabilizes the image, and a defilming bath for removing the backing layer from the support.

The desilvering step is carried out either in a single stage using a bleach-fix bath containing both a bleaching agent and a fixing agent (conventionally referred to as a "blix" bath) or in two stages using both a bleaching bath and a fixing bath.

Oxidizing agents conventionally incorporated in the bleaching solution are potassium ferricyanide, potassium bichromate, iron (III) complex salts and persulfate salts. The solution using potassium ferricyanide exhibits excellent bleaching action, but ferricyanide ions or ferrocyanide ions in their reduced form are discharged in the form of an overflow during processing or a carry-over into rinsing water after the bleaching and may sometimes experience photochemical oxidation to form cyanide compounds. The cyanide compounds are highly toxic and present a great hazard. Therefore, it is desired to develop bleaching agents that can be used in place of potassium ferricyanide.

Iron (III) complex salts are sometimes used as a bleaching agent in a bleach-fix solution intended for the processing of color photographic papers (see German Pat. Nos. 866,605 and 966410; British Pat. Nos. 746,567, 933,088 and 1,014,396). However, bleach-fixing agents containing the iron (III) complex salts are weak in oxidizing power and are not suitable for use in the processing of picture taking color photographic materials having high concentrations of silver halide and using silver iodobromide. Therefore, it is desired to increase the oxidizing power of bleaching solutions and bleach-fixing solutions using iron (III) complex salts.

Iron (III) complex salts may be used together with bromide salt. However, as in the case of the bleach-fixing solution, a bleaching bath containing iron (III) complex salts has a weak oxidizing power and takes an undesirably long period for completing the bleaching.

Another compounds known to be usable as bleaching agents are persulfate salts. A persulfate salt usually makes up a bleaching agent together with a chloride. However, one great defect with the bleaching bath containing a persulfate salt is that it has a still weaker oxidizing power than the one containing an iron (III) complex salt, and hence requires an extremely long time to complete the bleaching.

Bleaching accelerators are used in order to effect satisfactory bleaching or bleach-fixing with these bleaching or bleach-fixing solutions having weak bleaching power. Accelerators known for use with bleaching solution containing an iron (III) complex salt and those for use with the bleach-fixing solution containing both the iron (III) complex salt and thiosulfate include thiols such as aminoalkylene thiol, thioglycerin and cysteine, as well as disulfides such as cystine and cystamine (see U.S. Pat. No. 3,893,858).

Of these accelerators, aminoalkyl-one thiol is the most effective, but this compound is strongly malodorous and is not suitable for independent use. This problem can be solved by using a thiol precursor that is not malodorous and which releases thiol in the processing bath.

A method is known for increasing the effectiveness of a persulfate containing bleaching bath by adding a thio compound to either the bleaching bath or any one of the bath that are used after development up to the stage of bleaching (see Research Disclosure, No. 15704, May 1977). This publication lists as accelerating compounds aminoalkylene thiols (e.g. 2-aminoethane thiol, 3-aminopropane thiol, 2-dimethylaminoethane thiol, 3-dimethylaminopropane thiol, N-methyl-N-ethyl-aminoethane thiol and 2-diethylaminoethane thiol) and thiol precursors such as disulfide and isothiuronium salts. However, not all of these compounds have satisfactory accelerating effect, and many of them exhibit the desired accelerating effect for some time after the preparation of the processing solution, but their effect is significantly decreased after the solution is used to process photographic materials or after the solution is stored for some period. In order to solve this practical problem, an increased amount of the accelerator is incorporated in the processing solution, or alternatively, an increased amount of the accelerator is used in a replenisher for maintaining the effectiveness of the accelerator.

SUMMARY OF THE INVENTION

Therefore, one object of the present invention is to provide a processing method capable of forming a color photographic image of good quality.

Another object of the present invention is to provide a processing method that achieves an enhanced bleaching effect and which ensures consistent performance over an extended period of time.

As a result of extensive studies made to achieve these objects, there has now been discovered a processing method that is free from the defects of the conventional techniques and which exhibits good performance over an extended period of time. It has now been found that these objects of the present invention can be accomplished by using a very limited number of isothiuronium salt derivatives as a bleaching accelerator.

The above stated objects of the present invention can be achieved by a method for processing an exposed silver halide photographic material which comprises the steps of (1) treating said material in a color developing bath, (2) treating the developed material in a bath having incorporated therein a compound of formula (I) or a salt thereof:

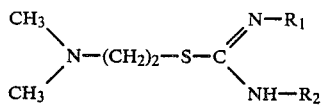

(I)

wherein $R_1$ and $R_2$ each represent a hydrogen or an alkyl group having 1 to 5 carbon atoms (e.g., methyl, ethyl, isopropyl, or n-pentyl), provided that at least one of $R_1$ and $R_2$ is an alkyl group and $R_1$ and $R_2$ may be the same or different and (3) treating said material in a bleaching.

Most preferred examples of $R_1$ and $R_2$ are methyl and ethyl groups, i.e., at least one of $R_1$ and $R_2$ is a methyl or ethyl group.

Examples of the salt of the compound of formula (I) include strong acid salts such as hydrochloride salt, sulfate salt, p-toluenesulfonate salt, and methanesulfonate salt.

Preferred specific examples of the compound (I) are listed below.

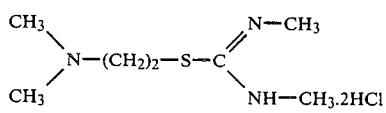

(I-1)

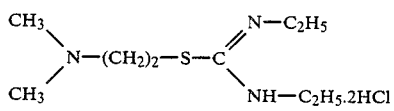

(I-2)

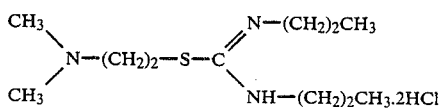

(I-3)

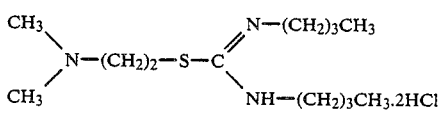

(I-4)

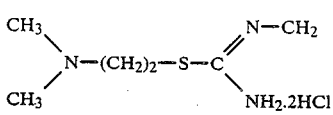

(I-5)

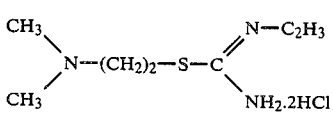

(I-6)

-continued

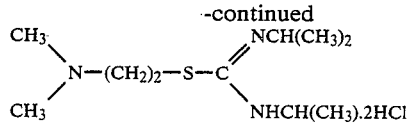

(I-7)

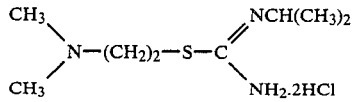

(I-8)

These compounds can be produced by various routes of synthesis, an example of which is shown below:

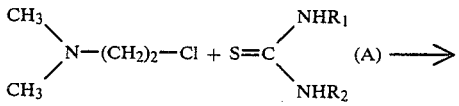

(A)

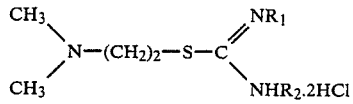

(B)

wherein $R_1$ and $R_2$ are the same as defined for formula (I) above. More specifically, synthesis of a compound of formula (I) can be conducted in an alcohol (e.g. n-butanol) solution of dimethylaminoethyl chloride and thiourea (A), which is heated under reflux to obtain the desired compound (B).

Specific examples of methods for synthesizing some of the compounds of formula (I) are illustrated below.

(1) Synthesis of Compound (I-1)

A mixture of 290 g (2.0M) of dimethylaminoethylchloride hydrochloride salt and 208 g (2.0M) of 1,3-dimethylthiourea was dispersed in a mixture of n-butanol (500 ml) and water (50 ml), and the resulting dispersion was stirred over an oil bath at 140° C. for 4 hours. Thereafter, the reaction solution was concentrated under vacuum and acetone was added to the resulting crystals. The mixture was stirred at room temperature and the resulting crystals were filtered off and washed with acetone. Acetone was added to the washed crystals and the mixture was heated under reflux. The resulting crystals were filtered off and washed with acetone to obtain 410 g of the desired compound (yield: 82.6%) having a melting point of 193°-195° C.

(2) Synthesis of Compound (I-2)

A mixture of 29 g (0.2M) of dimethylaminoethyl chloride hydrochloride salt and 26.4 g (0.2M) of 1,3-diethylthiourea was dispersed in a mixture of n-butanol (70 ml) and water (7 ml), and the resulting dispersion was stirred over an oil bath at 140° C. for 4 hours. Thereafter, the reaction solution was treated as in the synthesis of compound (I-1), and 45 g of the desired compound (yield: 81.5%) having a melting point of 140°-143° C. was obtained.

(3) Synthesis of Compound (I-4)

A mixture of 290 g (2.0M) of dimethylaminoethyl chloride hydrochloride salt and 376 g (2.0M) of 1,3-n-butylthiourea was dispersed in a mixture of n-butanol (500 ml) and water (50 ml), and the resulting dispersion was stirred over an oil bath at 140° C. for 4 hours. Thereafter, the reaction solution was treated as in the synthesis of compound (I-1), and 406 g of the desired compound (yield: 61.1%) having a melting point of 132°–135° C. was obtained.

(4) Synthesis of Compound (I-7)

A mixture of 29 g (0.2M) of dimethylaminoethylchloride hydrochloride salt and 32 g (0.2M) of 1,3-diisopropylthiourea was dispersed in a mixture of n-butanol (70 ml) and water (7 ml), and the resulting dispersion was stirred over an oil bath at 140° C. for 4 hours. Thereafter, the reaction solution was treated as in the synthesis of compound (I-1), and 39.6 (yield: 65.1%) of the desired compound having a melting point of 150°–153° C. was obtained.

Other compounds of formula (I) can be readily produced by appropriate modifications of the methods shown above.

The compound of formula (I) according to the present invention is incorporated in a "pre-processing solution", or the solution used in any of the steps that precede the processing with a bath having the noted bleaching ability, namely, the bleaching solution or bleach-fixing solution. As used herein, the "pre-processing solution" means any of the processing solutions that are used after the developing step and before the processing with the bleaching solution or bleach-fixing solution. The pre-processing solution is ordinarily used just before the processing with the bleaching solution or the bleach-fixing solution, but if necessary, another processing solution may be employed between the pre-processing solution and the bleaching or bleach-fixing solution. If the developing step is immediately followed by the bleaching or bleach-fixing step, the desired acceleration of the bleaching cannot be obtained by simply incorporating the compound of formula (I) of the present invention in the developing solution. The compound of formula (I) of the present invention may be incorporated only in the pre-processing solution before the bleaching solution or the bleach-fixing solution or the pre-processing solution defined above. Alternatively, the compound of formula (I) (also referred to hereinafter simply as "compound (I)) may be incorporated in both the bleaching or bleach-fixing solution and the pre-processing solution. In whichever manner of the above described addition methods, the compound (I) provides the desired acceleration of the bleaching. The amount of the compound (I) added to each of the processing solutions mentioned above varies with the type of processing solution to which the compound is added, the type of the photographic material to be processed, and the processing temperature or the duration of the intended processing, but a concentration range of from $1\times10^{-3}$ to $2\times10^{-1}$ mol per liter is generally preferred, and the range of $5\times10^{-3}$ to $5\times10^{-2}$ mol per liter is particularly preferred. Generally speaking, the addition of a small amount results in sufficient acceleration of the bleaching. On the other hand, if the addition is more than necessary, the compound (I) may form a precipitate that stains the photographic material being processed or retards the subsequent fixing. Therefore, the optimum range for the addition of the compound (I) will be properly determined depending on the particular case.

If the compound (I) of the present invention is to be added to a certain processing solution, it may be preliminarily dissolved in a suitable medium such as water, alkali, or organic acid without having any adverse effects on the effect of the compound to accelerate the bleaching.

When the compound (I) of the present invention is incorporated in a pre-processing solution bath (pre-bath) that is used prior to the bleaching step or bleach-fixing step, the pre-bath may have a variety of compositions. The simplest composition is an aqueous solution of the compound (I). Advantageously, the aqueous solution may also contain acids such as acetic acid and boric acid, alkalies such as sodium hydroxide, or salts such as sodium sulfite, sodium acetate, sodium borate, sodium carbonate, and sodium bicarbonate. The pre-bath may have any value of pH without sacrificing the effectiveness of the compound (I). However, if the pH is too high, a stain may form, and therefore, the pre-bath is preferably used at pHs not higher than 9, and the range of from 3 to 7 is particularly preferred. The pre-bath may contain an anti-precipitation agent made of a variety of chelate compounds, a hardener made of various compounds such as alum or aldehyde compounds, a pH buffer, a fixing agent for halogen salts, an antioxidant (e.g. hydroxylamine or hydrazine), antiswelling agent (e.g. sodium sulfate or magnesium sulfate) or a surfactant. Water rising or stop-fixing may intervene between the pre-bath and the bleaching or bleach-fixing bath, and even in this case, the compound (I) can effectively accelerate bleaching if it is incorporated in the pre-bath. However, if the compound (I) is incorporated only in the pre-bath, the latter is preferably used immediately before the bleaching or bleach-fixing bath.

The processing with the pre-bath is usually performed at between 20° and 50° C. and continues for 5 seconds to 5 minutes (preferably from 10 seconds to 2 minutes).

The bleaching or bleach-fixing solution used in the method of the present invention contains an iron (III) complex salt or a persulfate salt as a bleaching agent. Typical examples of the iron (III) complex salt are ethylenediaminetetracetic acid iron (III) complex, nitrilotriacetic acid iron (III) complex, and cyclohexanediaminetetracetic acid iron (III) complex, as well as ammonium and alkali metal salts thereof. However, it should be understood that other iron (III) complex salts may be used. These iron (III) complex salts may be used in combination with other complex salts such as Co (III) and Cu (II) complex salts.

The bleaching solution may further contain a rehalogenating agent such as a bromide (e.g., potassium bromide, sodium bromide, or ammonium bromide) or a chloride (e.g., potassium chloride, sodium chloride, or ammonium chloride). Additives generally known for use in bleaching solutions may also be incorporated, and they include one or more inorganic acids, organic acids and salts thereof having a pH buffering ability, such as boric acid, borax, sodium metaborate, acetic acid, sodium sulfate, sodium carbonate, potassium carbonate, phosphorous acid, phosphoric acid, sodium phosphate, citric acid, sodium citrate, and tartaric acid.

The bleaching agent is used in an amount of 0.1 to 2 mols per liter of the bleaching solution. When an iron (III) complex salt is used as the bleaching agent, the bleaching solution is preferably used at a pH in the range of 3.0 to 8.0, and more preferably at a pH between 4.0 and 7.0.

When the composition according to the present invention is used as a bleach-fixing agent, it may be combined with an ordinary fixing agent, or a water-soluble silver halide dissolving agent, selected from thiosulfates (e.g., sodium thiosulfate, ammonium thiosulfate, sodium ammonium thiosulfate, and potassium thiosulfate); thiocyanates (e.g., sodium thiocyanate, ammonium thiocyanate and potassium thiocyanate); thioether compounds (e.g., ethylenebisthioglycolic acid and 3,6-dithia-1,8-octanediol); and thioureas. These fixing agents may be used either alone or in combination with themselves. If desired, a special bleach-fixing solution of the type shown in Japanese Patent Application (OPI) No. 155354/80 may be used, wherein a fixing agent is combined with a large quantity of a halide such as potassium iodide.

The composition of the bleach-fixing agent is such that one liter of the bleaching solution contains 0.1 to 2 mols of the iron (III) complex salt and 0.2 to 4 mols of the fixing agent.

The bleach-fixing solution may also contain any of the additives shown above that can be incorporated in the bleaching solution, as well as a preservative which may be selected from among various sulfites such as sodium sulfite, potassium sulfite, ammonium sulfite, and addition products of bisulfites and hydroxylamine, hydrazine or aldehyde compounds such as acetaldehyde added to sodium bisulfite. The bleach-fixing solution may further contain various fluorescent brighteners, defoaming agents or surfactants, organic solvents such as methanol, and known compounds capable of accelerating bleach-fixing, for example, the polyamine compounds shown in Japanese Patent Publication No. 8836/70 corresponding to U.S. Pat. No. 3,578,454, the thiourea derivatives shown in Japanese Patent Publication No. 8506/70, the iodides shown in German Pat. No. 1127715, the polyethylene oxides shown in German Pat. No. 966410, the nitrogen-containing heterocyclic compounds shown in German Pat. No. 1290812, as well as other thioureas. The bleach-fixing solution is preferably used at a pH between 4.0 and 9.0, more preferably between 5.0 and 8.0.

The bleaching solution used in the present invention may contain sodium persulfate, potassium persulfate or ammonium persulfate as the bleaching agent, and these compounds may be used either alone or in combination with themselves. These persulfate salts are used in an amount of 5 to 200 g, preferably 15 to 100 g, per liter of the bleaching solution. The bleaching solution may also contain a chloride such as sodium chrolide, potassium chloride or ammonium chloride, or a bromide such as sodium bromide, potassium bromide or ammonium bromide. These chlorides and bromides are used in an amount of 2 to 200 g, preferably 5 to 100 g, per liter of the bleaching solution. The bleaching solution may further contain an inorganic acid such as sulfuric acid, hydrochloric acid, nitric acid, phosphoric acid or boric acid, a carboxylic acid such as acetic acid, propionic acid, citric acid, tartaric acid or succinic acid, as well as alkali metal salts or ammonium salts thereof. In order to prevent the evolution of a halogen gas, the bleaching solution may contain gelatin, carboxylic acid or amino acid as shown in Research Disclosure No. 17556, November 1978, as well as a cobaltous salt. Other compounds that may be incorporated in the bleaching solution are succinimide, phthalimide, α-pyrrolidone, saccharin, hydantoin, uracil and cyanuric acid as shown in Japanese Patent Application (OPI) No. 149944/80 (the symbol OPI as used herein means as unexamined published Japanese patent application); pyrroles, imidazoles, pyrazoles, triazoles, tetrazoles, indoles, benzimidazoles, and benzotriazoles as shown in Japanese Patent Application (OPI) No. 137529/80 corresponding to U.S. Pat. No. 4,292,401. The bleaching agent may contain a softening agent selected from among aminopolycarboxylic acids and phosphonic acids.

The color developer used in the method of the present invention contains a primary aromatic amino compound as the color developing agent, and a suitable developing agent can be selected from among those which are extensively used in various color photographic processes. These developing agents include aminophenolic and p-phenylenediamine derivatives. These compounds are commonly used in the form of their salts, e.g., hydrochloride or sulfate salts, which are more stable than the compounds in their free state. These compounds are generally used in an amount of about 0.1 to about 30 g, and preferably from about 1 to about 15 g, per liter of the color developer.

Illustrative aminophenolic developing agents include o-aminophenol, p-aminophenol, 5-amino-2-oxy-toluene, 2-amino-3-oxy-toluene, and 2-oxy-3-amino-1,4-dimethyl-benzene.

Primary aromatic amino compounds useful as the color developing agents are N,N-dialkyl-p-phenylenediamine compounds wherein the alkyl and phenyl groups may be substituted or unsubstituted. Particularly useful examples include N,N-diethyl-p-phenylenediamine hydrochloride salt, N-methyl-p-phenylenediamine hydrochloride salt, N,N-dimethyl-p-phenylenediamine hydrochloride salt, 2-amino-5-(N-ethyl-N-dodecylamino)-toluene, N-ethyl-N-β-methanesulfonamidoethyl-3-methyl-4-aminoaniline sulfate salt, N-ethyl-N-β-hydroxyethylaminoaniline, 4-amino-3-methyl-N,N-diethylaniline and 4-amino-N-(2-methoxyethyl)-N-ethyl-3-methylaniline-p-toluene sulfonate.

In addition to these primary aromatic amino compounds used as the color developing agent, the alkaline color developer used in the present invention may optionally contain various components which are conventionally incorporated in color developers. Among such additives are alkali agents (e.g., sodium hydroxide, sodium carbonate and potassium carbonate), alkali metal sulfite salts, alkali metal bisulfite salts, alkali metal thiocyanate salts, alkali metal halides, benzyl alcohol, water softeners and thickeners. The color developer used in the present invention generally has a pH of at least 7, and the most general range is from about 10 to about 13. Any of the known silver halide color photographic materials can be processed by the method of the present invention using the compound (I). Particularly advantageous results are obtained when the method of the present invention is applied to coupler-containing, multilayer, negative color photographic materials, photographic color prints, or photographic materials designed for color reversal processing. Other materials that can be processed by the present invention include color X-ray photographic materials and single-layer special color photographic materials. The method of the present invention permits processing with couplers being incorporated in the developing solution.

The silver halide photographic materials illustrated above may be developed by the incorporated-coupler developing type method wherein coupler is contained in a photosensitive material (as described in U.S. Pat. Nos. 2,376,679 and 2,801,171) or by the contained-coupler developing type method wherein coupler is contained in a developer (as shown in U.S. Pat. Nos. 2,252,718, 2,592,243, and 2,590,970). Any of the couplers that are generally known in the art may be used in the method of the present invention. Suitable cyan couplers are those compounds which have the basic naphtholic or phenolic structure and which form an indoaniline dye upon coupling. Suitable magenta couplers are those which have as the basic structure a 5-pyrazolone ring with an active methylene group. Suitable yellow couplers are those which have a benzoylacetanilide, pivalylacetanilide, or acylacetanilide structure with an active methylene group. These yellow couplers may or may not have a substituent on the coupling position. The couplers may be 2-equivalent or 4-equivalent. The amulsions that can be used in the present invention may comprise any type of silver halide such as silver chloride, silver bromide, silver iodide, silver chlorobromide, silver chloroiodide, silver iodobromide, or silver chloroiodobromide. These silver halides can be protected by a natural colloid such as gelatin or by various synthetic colloids. The silver halide emulsions may contain conventional photographic additives such as stabilizers, sensitizers, hardeners, sensitizing dyes, and surfactants.

The advantages of the present invention are hereunder described in greater detail by reference to working examples, to which the scope of the invention is by no means limited.

EXAMPLE 1

A subbed polyethylene terephthalate support was coated with the following six photographic layers.

First layer (red-sensitive emulsion layer):

A thousand grams of a silver iodobromide emulsion (5 mol% silver iodide) containing 10 g of the silver halide and 5 g of gelatin per 100 g of the emulsion was mixed with 500 g of a gelatin dispersion of a cyan coupler (C-1 as indicated below) having a silver to coupler molar ratio of 7:1, 50 cc of a 1% aqueous solution of a stabilizer (A-1 as indicated below), 50 cc of a 1% aqueous solution of a coating aid (T-1 as indicated below) and 20 cc of a 2% aqueous solution of a hardener (H-1 as indicated below). The resulting coating solution was applied to the support to give a dry thickness of 4μ.

Second layer (intermediate layer):

A thousand grams of a 5% aqueous gelatin solution was mixed with 100 g of an aqueous gelatin dispersion of an anti-color mixing agent (A-2 as indicated below), 50 cc of a 1% aqueous solution of a coating aid (T-1) and 20 cc of a 2% aqueous solution of a hardener (H-1). The resulting coating solution was applied to the first layer to give a dry thickness of 1μ.

Third layer (green-sensitive layer):

A thousand grams of a silver iodobromide emulsion (5 mol% silver iodide) containing 10 g of the silver halide and 5 g of gelatin per 100 g of the emulsion was mixed with 700 g of a gelatin dispersion of a magenta coupler (C-2 as indicated below) having a silver to coupler molar ratio of 7:1, 50 cc of a 1% aqueous solution of a stabilizer (A-1), 50 cc of a 1% aqueous solution of a coating aid (T-1) and 20 cc of a 2% aqueous solution of a hardener (H-1). The resulting coating solution was applied to the second layer to give a dry thickness of 4μ.

Fourth layer (yellow filter layer):

A thousand grams of a 5% gelatin dispersion of colloidal silver was mixed with 100 cc of a 1% aqueous solution of a coating aid (T-1) and 20 cc of a 2% aqueous solution of a hardener (H-1). The resulting coating solution was applied to the third layer so that the silver deposit was 0.5 mg/100 $cm^2$.

Fifth layer (blue-sensitive emulsion layer):

A thousand grams of a silver iodobromide emulsion (5 mol% silver iodide) containing 10 g of the silver halide and 5 g of gelatin per 100 g of the emulsion was mixed with 500 g of a gelatin dispersion of a yellow coupler (C-3 as indicated below) having a silver to coupler molar ratio of 7:1, 50 cc of a 1% aqueous solution of a stabilizer (A-1), 50 cc of a 1% aqueous solution of a coating aid (T-1) and 20 cc of a 2% aqueous solution of a hardener (H-1). The resulting coating solution was applied to the fourth layer to give a dry thickness of 4μ.

Sixth layer (protective layer):

A 5% aqueous gelatin solution was mixed with 100 cc of a 1% aqueous solution of a coating aid (T-1) and 20 cc of a 1% aqueous solution of a hardener (H-1). The resulting coating solution was applied to the fifth layer to give a dry thickness of 1μ.

C-1:

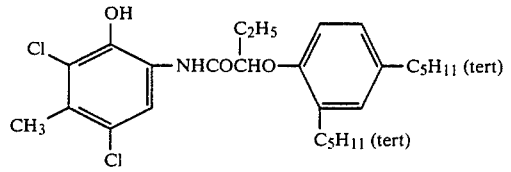

Method of emulsification: Seventy-five grams of the cyan coupler (C-1) was dissolved in a mixture of dibutyl phthalate (100 cc) and ethyl acetate (200 cc). The resulting mixture was emulsified in 600 g of a 10% aqueous gelatin solution together with a dispersion aid.

C-2:

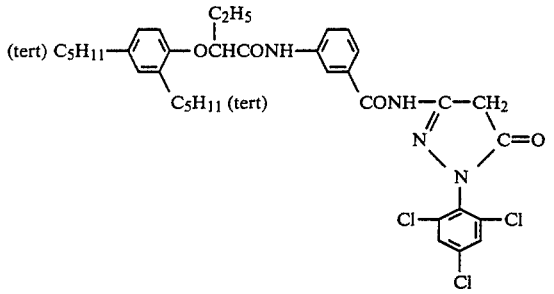

Method of emulsification: same as in the case of the cyan coupler (C-1) except that it was replaced by 75 g of a magenta coupler (C-2).

C-3:

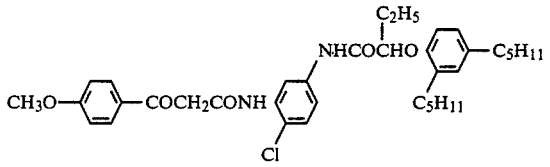

Method of emulsification: Same as in the case of the cyan coupler (C-1) except that it was replaced by 90 g of a yellow coupler (C-3).

A-1:

-continued

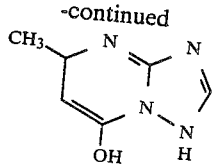

A-2:

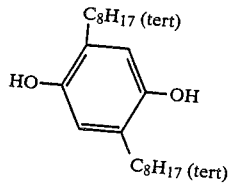

Preparing emulsion from A-2:

A hundred grams of the anti-color mixing agents (A-2) was dissolved in a mixture of dibutyl phthalate (200 cc) and ethyl acetate (200 cc), and the resulting mixture was emulsified in 500 cc of a 10% aqueous gelatin solution together with a dispersion aid.

T-1:

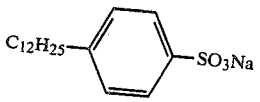

H-1:

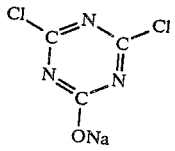

Samples of the color reversal film prepared by the above procedure were given an appropriate exposure and processed photographically either in the fresh state or after being stored for 7 days in polyethylene jars at 40° C. Six different pre-processing baths having the bleaching accelerating compounds indicated in Table 1 below were employed between the color development and second water rinsing. The processing schedule consisted of the following steps.

| | | |
|---|---|---|
| First development | 43° C. | 2 min. |
| Stopping | 40° C. | 20 sec. |
| Water rinsing | 40° C. | 40 sec. |
| Color development | 46° C. | 2 min. and 15 sec. |
| Processing in pre-bath | 40° C. | 15 sec. |
| Water rinsing | 40° C. | 5 sec. |
| Bleaching | 40° C. | 45 sec. |
| Fixing | 40° C. | |
| Water rinsing | 40° C. | |

-continued

| | |
|---|---|
| Water | 800 ml |
| Glacial acetic acid | 30.0 ml |
| Sodium hydroxide | 1.65 g |
| Water to make | 1,000 ml |
| pH (adjusted to) | 3.50 |
| Color developer | |
| Water | 800 ml |
| Sodium hexametaphosphate | 5.0 g |
| Benzyl alcohol | 4.50 ml |
| Anhydrous sodium sulfite | 7.50 ml |
| Tertiary sodium phosphate ($12H_2O$) | 36.0 g |
| Sodium bromide | 0.90 g |
| Potassium iodide (0.1% solution) | 90 ml |
| Sodium hydroxide | 3.25 g |
| Citrazinic acid | 1.50 g |
| N—ethyl-N—β-methanesulfonamidoethyl-3-methyl-4-aminoaniline sesquisulfate monohydrate | 11.0 g |
| Ethylenediamine | |
| Tert-butylamineborane | 3.00 g |
| Water to make | 0.07 g |
| pH (adjusted to) | 1,000 ml |
| Pre-bath | 11.65 |
| Water | 800 ml |
| Anhydrous sodium sulfite | 12 g |
| Glacial acetic acid | 10 ml |
| Bleaching accelerator (see Table 1) | $1 \times 10^{-2}$ mol |
| Water to make | 1,000 ml |
| pH (adjusted to) | 3.5 |
| Bleaching solution | |
| Water | 800 ml |
| Sodium persulfate | 60 g |
| Sodium chloride | 30 g |
| Phosphoric acid (85 wt % aqueous sol.) | 11.8 ml |
| Sodium hydroxide | 6.4 g |
| β-Aminopropionic acid | 2 g |
| Water to make | 1,000 ml |
| pH (adjusted to) | 2.7 |
| Fixing solution | |
| Water | 600 ml |
| Ammonium thiosulfate (58 wt % aq. sol.) | 169 ml |
| Anhydrous sodium sulfite | 11.5 g |
| Ethylenediaminetetraacetic acid disodium salt | 0.5 g |
| Anhydrous sodium acetate | 12 g |
| Glacial acetic acid | 9 ml |
| Water to make | 1,000 ml |
| pH (adjusted to) | 5.5 |
| Stabilizing bath | |
| Water | 800 ml |
| Formalin (37.5 wt % aq. sol.) | 6.0 ml |
| Water to make | 1,000 ml |

By X-ray fluorometry, the respective film samples thus processed were checked for the amount of residual silver in the area having maximum density. The results are shown below.

TABLE 1-continued

| Sample No. | Bleaching accelerator | Residual silver ($\mu g/cm^2$) Fresh | After storage of pre-bath for 7 days |
|---|---|---|---|
| | 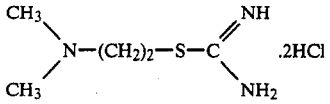 | | |
| | Comparative compound (3) 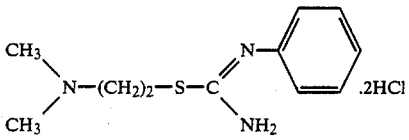 | | |

The pre-baths containing the bleaching accelerating compounds according to the present invention proved satisfactorily effective whether they were in the fresh state or stored at 40° C. for 7 days. In either case, the amount of the residual silver was negligibly small and a sharp color image was obtained.

On the other hand, the pre-baths containing the comparative compounds were far less effective in accelerating the bleaching. Samples Nos. 3 and 4 had large quantities of residual silver even when they were processed with fresh pre-baths. All of the samples that were processed with the comparative pre-baths after they were left to stand for 7 days at 40° C. had a residual silver deposit that was significantly higher than when they were processed with the fresh pre-baths. This indicates that the performance characteristics of the comparative compounds greatly deteriorated during storage.

EXAMPLE 2

The procedure of Example 1 was repeated except that the bleaching and fixing solutions were replaced by a bleach-fixing solution having the formulation shown below, and that the processing with this bleach-fixing solution was effected for 4 minutes.

| Bleach-fixing solution | |
|---|---|
| Components | Amount |
| Water | 700 ml |
| Anhydrous sodium sulfite | 10 g |
| Ammonium thiosulfate (70% sol.) | 150 ml |
| Ethylenediaminetetraacetic acid iron (III) ammonium salt | 100 g |
| Ethylenediaminetetraacetic acid disodium salt | 5 g |
| Water to make | 1,000 ml |
| pH | 6.5 |

By X-ray fluorometry, the respective film samples thus processed were checked for the amount of residual silver in the area having maximum density. The results are shown in Table 2, from which one can see that the compounds (I) according to the present invention have great ability to accelerate desilvering.

TABLE 2

| Sample No. | Bleaching accelerator | Residual silver ($\mu g/cm^2$) Fresh | After storage of pre-bath for 7 days |
|---|---|---|---|
| 1 | None | 280 | 300 |
| 2 | Comparative compound (1) | 5 | 43 |
| 3 | Comparative compound (2) | 19 | 67 |
| 4 | Comparative compound (3) | 25 | 83 |
| 5 | Compound (I-2) | 4 | 6 |
| 6 | Compound (I-4) | 4 | 7 |
| 7 | Compound (I-8) | 5 | 6 |

EXAMPLE 3

Samples of a multi-layer color photographic material were prepared. Each of them had the following layers on a cellulose triacetate film support.

Layer I (anti-halation layer):

One kilogram of a black colloidal silver emulsion (containing 15 g of black silver and 100 g of gelatin per kg of the emulsion) was mixed with 40 cc of a 5 wt% aqueous solution of a coating aid (sodium p-dodecylbenzenesulfonate). The resulting coating solution was applied to the support to give a dry thickness of 2$\mu$.

Layer II (intermediate gelatin layer with a dry thickness of 1.0$\mu$):

Layer III (silver halide emulsion layer having low red sensitivity):

A silver iodobromide emulsion with 5 mol% silver iodide (comprising grains with an average size of 0.3$\mu$ and containing 100 g of silver halide and 70 g of gelatin per kg of the emulsion) was prepared. One kilogram of this emulsion was mixed with 210 cc of a 0.1% methanol solution of a red-sensitive spectral sensitizer (anhydro-5,5-dichloro-9-ethyl-3,3'-di(3-sulfopropyl) thiacarbocyaninehydroxide pyridinium salt), then with 20 cc of a 5 wt% aqueous solution of 5-methyl-7-hydroxy-2,3,4-triazaindolizine. Subsequently, emulsions (1) and (2) of a cyan coupler having the formulations indicated below were added in respective amounts of 400 g and 200 g. Then, 200 cc of a 2 wt% aqueous solution of colored cyan coupler (CC-1) and 30 cc of a 2 wt% aqueous solution of a gelatin hardener (2-hydroxy-4,6-dichlorotriazine sodium salt) were added to obtain the intended silver halide emulsion having low red sensitivity. This emulsion was applied to give a dry thickness of 3.5$\mu$.

CC-1:

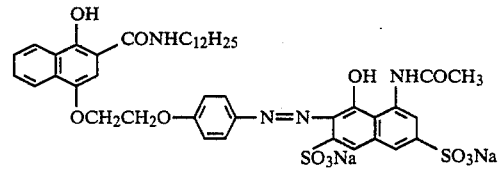

Emulsion (1):

| | Components | Amount |
|---|---|---|
| (1) | 10 wt % aqueous gelatin solution | 1,000 g |
| (2) | Sodium p-dodecylbenzenesulfonate | 5 g |
| | Tricresyl phosphate | 60 cc |
| | Cyan coupler (C-101) | 70 g |
| | Ethyl acetate | 100 cc |

The mixture (2) was heated at 55° C. to form a solution, which was added to the solution (1) that had been heated to 55° C. The resulting mixture was formed into an emultion with a colloid mill.

C-101:

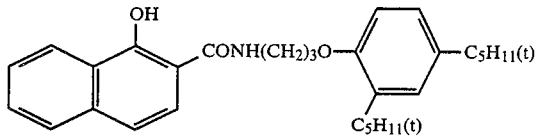

Emulsion (2):

| | Components | Amount |
|---|---|---|
| (1) | 10 wt % aqueous gelatin solution | 1,000 g |
| (2) | Sodium p-dodecylbenzenesulfonate | 5 g |
| | Tricresyl phosphate | 60 cc |
| | Cyan coupler (C-101) | 70 g |
| | DIR compound (D-1) | 10 g |
| | Ethyl acetate | 100 cc |

The mixture (2) was heated at 55° C. to make a solution, which was added to the solution (1) that had been heated to 55° C. The resulting mixture was formed into an emulsion with a colloid mill.

D-1:

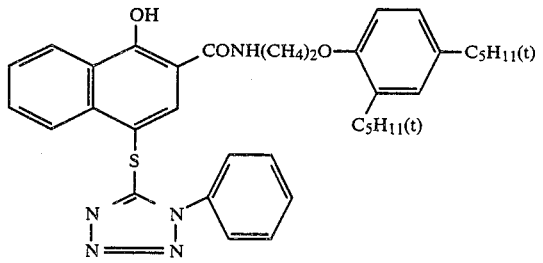

Layer IV (silver halide emulsion layer having high red sensitivity):

The following modifications were made to the formulation of the silver halide emulsion from which Layer III was made:

| | |
|---|---|
| Average size of silver halide grains | 0.9μ |
| Amount of the red-sensitive color sensitizer | 140 cc |
| Emulsion (1) | 220 g |
| Emulsion (2) | 30 g |

The thus prepared coating solution was applied to give a dry thickness of 2.2μ.

Layer V (intermediate gelatin layer with a dry thickness of 0.8μ):

Layer VI (silver halide emulsion layer with low green sensitivity):

One kilogram of the silver iodobromide emulsion used in Layer III was successively mixed with 180 cc of a 0.1% methanol solution of a green-sensitive sensitizing dye (3,3'-di(2-sulfoethyl)-9-ethylbenzoxacarbocyanine pyridinium salt), and 20 cc of a 5 wt% aqueous solution of 5-methyl-7-hydroxy-2,3,4-triazaindolizine. Then, emulsions (3) and (4) of a magenta coupler having the formulations indicated below were added in respective amounts of 320 g and 180 g. Subsequently, 50 cc of a 2 wt% aqueous solution of a gelatin hardener (2-hydroxy-4,6-dichlorotriazine sodium salt) was added to obtain the intended silver halide emulsion having low green sensitivity. This emulsion was applied to give a dry thickness of 3.2μ.

Layer VII (silver halide emulsion layer with high green sensitivity):

The following modifications were made to the formulation of the silver halide emulsion from which layer VI was made:

| | |
|---|---|
| Average size of silver halide grains | 1.0μ |
| Content of silver iodide in the emulsion | 6.5 mol % |
| Amount of the green-sensitive color sensitizer | 100 cc |
| Emulsion (3) | 150 g |
| Emulsion (4) | 30 g |

The so prepared coating solution was applied to give a dry thickness of 2.2μ.

Emulsion (3):

| | Components | Amount |
|---|---|---|
| (1) | 10 wt % aqueous gelatin solution | 1,000 g |
| (2) | Sodium p-dodecylbenzenesulfonate | 5 g |
| | Tricresyl phosphate | 80 cc |
| | Magenta coupler (M-101) | 50 g |
| | Colored magenta coupler (CM-1) | 10 g |
| | Ethyl acetate | 120 cc |

The mixture (2) was heated at 55° C. to make a solution, which was added to the solution (1) that had been heated to 55° C. The resulting mixture was formed into an emulsion with a colloid mill.

M-101:

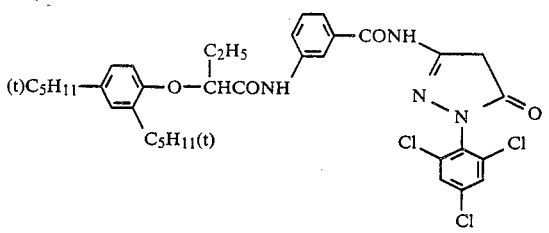

CM-1:

-continued

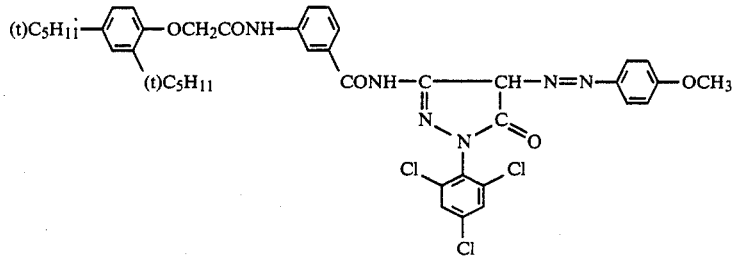

Emulsion (4):

| | Components | Amount |
|---|---|---|
| (1) | 10 wt % aqueous gelatin solution | 1,000 g |
| (2) | Sodium p-dodecylbenzenesulfonate | 5 g |
| | Tricresyl phosphate | 80 cc |
| | Magenta coupler (M-101) | 50 g |
| | Colored magenta coupler (CM-1) | 10 g |
| | DIR compound (D-2) | 15 g |
| | Ethyl acetate | 120 cc |

The mixture (2) was heated at 55° C. to form a solution, which was added to the solution (1) that had been heated to 55° C. The resulting mixture was formed into an emulsion with a colloid mill.

D-2:

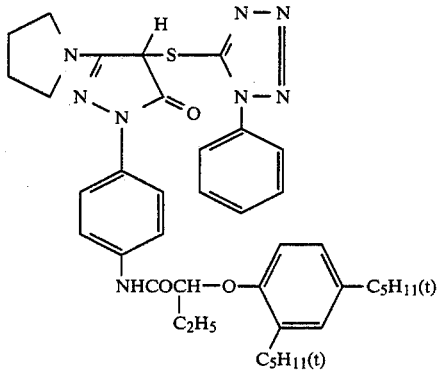

Layer VIII (yellow filter layer):

One kilogram of a yellow colloidal silver emulsion (containing 8.9 g of yellow colloidal silver and 69 g of gelatin per kg of the emulsion) was mixed with 100 cc of a 5 wt% aqueous solution of a coating aid (sodium p-dodecylbenzenesulfonate). The resulting coating solution was applied to give a thickness of 1.6μ (Ag deposit: 50 mg/m$^2$).

Layer IX (silver halide emulsion layer with low blue sensitivity):

One kilogram of a silver iodobromide emulsion which was the same as what was used in Layer III except that the average grain size was 0.5μ was mixed with 20 cc of a 5 wt% aqueous solution of 5-methyl-7-hydroxy-2,3,4-triazaindolizine and 1,500 g of emulsion (5) of a yellow coupler having the formulation indicated below. Then, 50 cc of a 2 wt% aqueous solution of a gelatin hardener (2-hydroxy-4,6-dichlorotriazine sodium salt) was added to provide a silver halide emulsion having low blue sensitivity. This emulsion was applied to give a dry thickness of 3.0μ.

Emulsion (5):

| | Components | Amount |
|---|---|---|
| (1) | 10 wt % aqueous gelatin solution | 1,000 g |
| (2) | Sodium p-dodecylbenzenesulfonate | 5 g |
| | Tricresyl phosphate | 80 cc |
| | Yellow coupler (Y-1) | 100 g |
| | Ethyl acetate | 120 g |

The mixture (2) was heated at 55° C. to make a solution, which was added to the solution (1) that had been heated to 55° C. The resulting mixture was formed into an emulsion with a colloid mill.

Y-1:

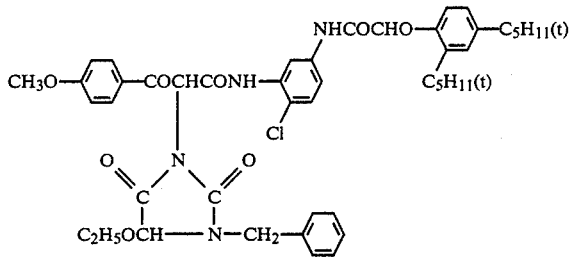

Layer X (silver halide emulsion layer with high blue sensitivity):

The following modifications were made to the silver halide emulsion from which Layer IX was made:

| | |
|---|---|
| Average size of silver halide grains | 1.1μ |
| Emulsion (5) | 300 g |

The thus prepared coating solution was applied to Layer IX to give a dry thickness of 2.5μ.

Layer XI (protective gelatin layer with a dry thickness of 1.5μ):

The color negative film samples prepared by the above procedure were subjected to wedge exposure and subsequently processed according to the schedule shown below. Pre-baths containing the compounds indicated in Table 3 were used either in the fresh state or after they were stored in polyethylene jars for 7 days at 40° C.

| Steps | Temperature (°C.) | Time |
|---|---|---|
| Color development | 41 | 3 min. |
| Stopping | 38 | 30 sec. |
| Water rinsing | 38 | 30 sec. |
| Processing in pre-bath | 38 | 30 sec. |
| Bleaching | 38 | 3 min. |
| Water rinsing | 38 | 1 min. |
| Fixing | 38 | 2 min. |
| Water rinsing | 38 | 2 min. |
| Stabilization | 38 | 10 sec. |

The respective processing solutions had the following compositions.

| Components | Amount |
|---|---|
| Color developer: | |
| Sodium hydroxide | 2 g |
| Sodium sulfite | 2 g |
| Potassium bromide | 1.4 g |
| Sodium chloride | 1 g |
| Borax | 1 g |
| Hydroxylamine sulfate salt | 4 g |
| Ethylenediaminetetraacetic acid disodium salt | 2 g |
| 4-Amino-3-methyl-N—ethyl-N—(β-hydroxyethyl)aniline monosulfate | 4 g |
| Water to make | 1,000 ml |
| Stopping solution: | |
| Water | 800 ml |
| Glacial acetic acid | 30.0 ml |
| Sodium hydroxide | 1.65 g |
| Water to make | 1,000 ml |
| Pre-bath: | |
| Water | 800 ml |
| Anhydrous sodium sulfite | 12 g |
| Glacial acetic acid | 10 ml |
| Bleaching accelerator (see Table 1) | $3 \times 10^{-2}$ mol |
| Water to make | 1,000 ml |
| pH (adjusted to) | 3.8 |
| Bleaching solution: | |
| Sodium persulfate | 60 g |
| Sodium chloride | 20 g |
| Sodium dihydrogenphosphate | 15 g |
| Sodium tetrapolyphosphate | 2 g |
| β-Alanine | 2 g |
| Phosphoric acid (85 wt % aq. sol.) | 2.2 ml |
| Water to make | 1,000 ml |
| Fixing solution: | |
| Sodium thiosulfate | 150 g |
| Sodium sulfite (anhydrous) | 15 g |
| Borax | 12 g |
| Glacial acetic acid | 15 ml |
| Water to make | 1,000 ml |
| Stabilizing bath: | |
| Formaldehyde (37 wt % aq. sol.) | 10 ml |
| Water to make | 1,000 ml |

By X-ray fluorometry, the respective film samples thus processed were checked for the amount of residual silver in the area having maximum density. The results are shown in the following table.

TABLE 3

| Sample No. | Bleaching accelerator | Residual silver (μg/cm²) Fresh | After storage of pre-bath for 7 days |
|---|---|---|---|
| 1 | None | 570 | 550 |
| 2 | Comparative compound (1) | 2 | 23 |
| 3 | Comparative compound (4) | 2 | 36 |
| 4 | Comparative compound (5) | 3 | 20 |
| 5 | Compound (I-1) | 2 | 3 |
| 6 | Compound (I-6) | 2 | 3 |
| 7 | Compound (I-7) | 3 | 5 |

Comparative compound (4):

TABLE 3-continued

| Sample No. | Bleaching accelerator | Residual silver (μg/cm²) Fresh | After storage of pre-bath for 7 days |
|---|---|---|---|

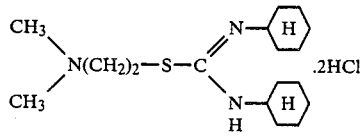

Comparative compound (5):

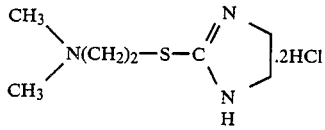

As shown in Table 3, the pre-baths containing the bleaching accelerating compounds according to the present invention proved satisfactorily effective whether they were in the fresh state or stored at 40° C. for 7 days. In either case, the amount of residual silver was very small and a sharp color image was obtained. On the other hand, the accelerating effect of the pre-baths containing the comparative compounds decreased markedly when they were stored for 7 days at 40° C., and all of the samples that were processed with the stored pre-baths had a residual silver deposit which was significantly higher than when they were processed with the fresh pre-baths. This indicates that the performance characteristics of the comparative pre-baths was greatly deteriorated during storage.

EXAMPLE 4

The procedure of Example 3 was repeated except that the composition of the bleaching solution was modified to the one indicated below, and that the bleaching was conducted for 3 minutes.

Bleaching solution:

| Components | Amount |
|---|---|
| Water | 700 ml |
| Ethylenediaminetetraacetic acid iron (III) ammonium salt | 80 g |
| Ethylenediaminetetraacetic acid sodium salt | 10 g |
| Potassium bromide | 100 g |
| Ammonium nitrate | 20 g |
| Water to make | 1,000 ml |
| pH | 6.0 |

By X-ray fluorometry, the respective film samples thus processed were checked for the amount of residual silver in the area having maximum density. The results are shown in Table 4, from which one can see that the compounds (I) of the present invention have great ability to accelerate desilvering even after storage for 7 days at 40° C.

TABLE 4

| Sample No. | Bleaching accelerator | Residual silver (μg/cm²) Fresh | After storage of pre-bath for 7 days |
|---|---|---|---|
| 1 | None | 65 | 67 |
| 2 | Comparative compound (1) | 3 | 19 |
| 3 | Comparative compound (4) | 6 | 23 |

TABLE 4-continued

| Sample No. | Bleaching accelerator | Residual silver ($\mu g/cm^2$) Fresh | After storage of pre-bath for 7 days |
|---|---|---|---|
| 4 | Comparative compound (5) | 4 | 17 |
| 5 | Compound (I-1) | 3 | 3 |
| 6 | Compound (I-6) | 3 | 4 |
| 7 | Compound (I-7) | 3 | 4 |

EXAMPLE 5

Samples of a multi-layer color photographic material were prepared. Each of them had a laminate of the first bottommost layer through the sixth topmost layer. The compositions of the respective layers are indicated in the following table, wherein the deposit amounts of the components of each layer are expressed in $mg/m^2$.

| | | |
|---|---|---|
| Sixth layer (protective) | Gelatin | 750 $mg/m^2$ |
| Fifth layer (green-sensitives) | Silver chlorobromide emulsion (with 30 mol % silver bromide) | 500 mg of silver/$m^2$ |
| | Magenta coupler (*1) | 600 $mg/m^2$ |
| | Coupler solvent (*2) | 110 $mg/m^2$ |
| | Gelatin | 1,300 $mg/m^2$ |
| Fourth layer (intermediate) | Gelatin | 500 $mg/m^2$ |
| Third layer (red-sensitive) | Silver chlorobromide emulsion (with 30 mol % silver bromide) | 500 mg of silver/$m^2$ |
| | Cyan coupler (*3) | 1,500 $mg/m^2$ |
| | Coupler solvent (*4) | 700 $mg/m^2$ |
| Second layer (intermediate) | Gelatin | 2,900 $mg/m^2$ |
| First layer (blue-sensitive) | Silver iodobromide emulsion (with 0.2 mol % silver iodide) | 100 mg of silver/$m^2$ |
| | Yellow coupler (*5) | 1,200 $mg/m^2$ |
| | Coupler solvent (*2) | 600 $mg/m^2$ |
| | Gelatin | 2,200 $mg/m^2$ |
| Support | Triacetyl cellulose | |

(*1) Coupler: 3-[3-{2-(2,4-di-tert-amylphenoxy)acetamido}benzamido]-1-(2,4,6-trichlorophenyl)-2-pyrazoline-5-one
(*3) Coupler: 2-[α-(2,4-di-tert-pentylphenoxy)butaneamido]-4,6-dichloro-5-methylphenol
(*4) Solvent: dibutyl phthalate
(*5) Coupler: α-pivaloyl-α-(2,4-dioxy-5,5'-dimethyloxazolidine-3-yl)-2-chloro-5-α-(2,4-di-tert-pentyloxy)bitaneamido acetanilide.

The color positive films thus prepared were subjected to wedge exposure and subsequently processed according to the schedule shown below. Pre-baths containing the compounds indicated in Table 5 were used either in the fresh state or after they were stored in polyethylene jars for 7 days at 40° C.

| Steps | Temperature (°C.) | Time |
|---|---|---|
| Color development | 36 | 3 min. |
| Stopping | 27 | 40 sec. |
| First fixing | 27 | 40 sec. |
| Water rinsing | 27 | 40 sec. |
| Processing in pre-bath | 27 | 20 sec. |
| Bleaching | 27 | 1 min. |
| Water rinsing | 27 | 40 sec. |
| Second fixing | 27 | 40 sec. |
| Water rinsing | 27 | 1 min. |
| Stabilization | 27 | 10 sec. |

| Components | Amount |
|---|---|
| Color developer: | |
| Water | 800 ml. |
| Sodium sulfite | 5 g |
| 4-Amino-3-methyl-N,N—diethylaniline | 3 g |
| Sodium carbonate | 20 g |

-continued

| | |
|---|---|
| Potassium bromide | 2 g |
| Water to make | 1,000 ml |
| pH | 10.5 |
| Stopping bath: | |
| Water | 800 ml |
| Sulfuric acid (6 N) | 50 ml |
| Water to make | 1,000 ml |
| pH | 1.0 |
| Fixing solution: | |
| Ammonium thiosulfate | 60 g |
| Sodium sulfite | 2 g |
| Sodium hydrogensulfite | 10 g |
| Water to make | 1,000 ml |
| pH | 5.8 |
| Pre-bath: | |
| Water | 800 ml |
| Anhydrous sodium sulfite | 12 g |
| Glacial acetic acid | 10 ml |
| Bleaching accelerator (see Table 5) | $2 \times 10^{-2}$ mol |
| Water to make | 1,000 ml |
| pH | 4.0 |
| Bleaching solution: | |
| Water | 800 ml |
| Sodium persulfate | 35 g |
| Sodium chloride | 15 g |
| Phosphoric acid (85 wt % aq. sol.) | 11.8 ml |
| Sodium hydroxide | 6.4 g |
| β-Aminopropionic acid | 2 g |
| Water to make | 1,000 ml |
| pH | 2.7 |
| Stabilizing bath: | |
| Water | 800 ml |
| Formalin (37.5 wt % aq. sol.) | 6 ml |
| Water to make | 1,000 ml |

By X-ray fluorometry, the respective film samples thus processed were checked for the amount of residual silver deposit in the area having maximum density. The results are shown in the following table.

TABLE 5

| Sample No. | Bleaching accelerator | Residual silver ($\mu g/cm^2$) Fresh | After storage of pre-bath for 7 days |
|---|---|---|---|
| 1 | None | 97 | 95 |
| 2 | Comparative compound (1) | 2 | 15 |
| 3 | Comparative compound (6) | 5 | 20 |
| 4 | Comparative compound (7) | 10 | 30 |
| 5 | Compound (I-1) | 2 | 3 |
| 6 | Compound (I-3) | 3 | 3 |
| 7 | Compound (I-5) | 2 | 4 |

Comparative compound (6):

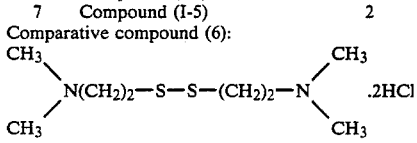

Comparative compound (7):

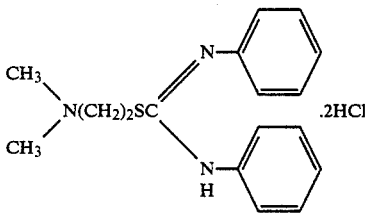

As shown in Table 5, the pre-baths containing the bleaching accelerators according to the present invention proved satisfactorily effective whether they were in the fresh state or stored at 40° C. for 7 days. In either case, the amount of residual silver was extremely small and a sharp color image was obtained. On the other hand, the accelerating effect of the pre-baths containing the comparative compounds decreased markedly when they were stored for 7 days at 40° C., and all of the samples that were processed with the stored pre-baths had a residual silver deposit which was significantly higher than when they were processed with the fresh pre-baths. This indicates that the performance characteristics of the comparative pre-baths was greatly deteriorated during storage.

While the invention has been described in detail and with reference to the specific embodiments thereof, it will be apparent to one skilled in the art that various changes and modifications can be made therein without departing from the spirit and scope thereof.

What is claimed is:

1. A method for processing an exposed silver halide color photographic material by development and desilvering, which comprises the steps of (1) treating said material in a color developing bath, (2) treating the developed material in a bath having incorporated therein at least one compound of formula (I) or a salt thereof:

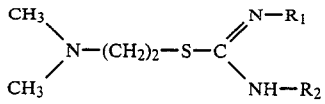

(I)

wherein $R_1$ and $R_2$ each represent a hydrogen atom or an alkyl group having 1 to 5 carbon atoms, provided that at least one of $R_1$ and $R_2$ is an alkyl group and $R_1$ and $R_2$ may be the same or different, and (3) treating said material in a bath having bleaching or bleach-fixing ability.

2. A method as in claim 1, wherein at least one of $R_1$ and $R_2$ is a methyl or ethyl group.

3. A method as in claim 1, wherein the compound of formula (I) is incorporated in a concentration range of from $1\times10^{-3}$ to $2\times10^{-1}$ mol per liter.

4. A method as in claim 1, wherein the compound of formula (I) is incorporated in a concentration range of from $5\times10^{-3}$ to $5\times10^{-2}$ mol per liter.

5. A method as in claim 1, wherein the bath of step (2) has a pH not higher than 9.

6. A method as in claim 1, wherein the bath of step (2) has a pH in the range of from 3 to 7.

7. A method as in claim 1, wherein processing in the bath of step (2) is performed at between 20° C. and 50° C. for a period of from 5 seconds to 5 minutes.

8. A method as in claim 1, wherein processing in the bath of step (2) is performed at between 20° C. and 50° C. for a period of from 10 seconds to 2 minutes.

9. A method as in claim 1, wherein the compound of formula (I) is incorporated in the both bathes of step (2) and step (3).

* * * * *